United States Patent [19]

Kiefer et al.

[11] Patent Number: 4,779,564

[45] Date of Patent: Oct. 25, 1988

[54] APPARATUS FOR ELECTROSTATIC POWDER SPRAY COATING AND RESULTING COATED PRODUCT

[75] Inventors: Steven L. Kiefer, Argos; Stephen Hart; Ronald G. Creech, both of Warsaw, all of Ind.

[73] Assignee: Morton Thiokol, Inc., Chicago, Ill.

[21] Appl. No.: 61,838

[22] Filed: Jun. 11, 1987

Related U.S. Application Data

[62] Division of Ser. No. 871,972, Jun. 9, 1986.

[51] Int. Cl.[4] ..... B05B 5/02

[52] U.S. Cl. ..... 118/624; 118/629; 118/630; 118/633; 239/706

[58] Field of Search ..... 118/628, 629, 624, 630, 118/633; 239/690, 704–708

[56] References Cited

U.S. PATENT DOCUMENTS

| | | | |
|---|---|---|---|
| 2,773,472 | 12/1956 | Lamm | 118/51 |
| 3,336,903 | 8/1967 | Point | 118/624 |
| 3,687,705 | 8/1972 | Kilbane | 427/14.1 |
| 4,009,829 | 3/1977 | Sickles | 239/15 |
| 4,228,961 | 10/1980 | Itoh | 239/707 X |
| 4,297,386 | 10/1981 | Gillette | 118/624 X |
| 4,343,828 | 8/1982 | Smead et al. | 427/27 |

*Primary Examiner*—Evan Lawrence

*Attorney, Agent, or Firm*—Gerald K. White

[57] ABSTRACT

An electrostatic powder spray coating method and apparatus for producing evenly coated continuous films of thermoplastic and thermosetting powders on substrates or parts having electrically conductive geometric complex surfaces enables the use, without the occurrence of "cobwebbing," of significantly higher charging voltages for the spray gun in the spray coating of preheated substrates and parts, thus allowing faster coating lines. The invention features the use of a grounded electrically conductive ring for grounding the ionized field in the powder discharge region of the spray gun.

9 Claims, 4 Drawing Sheets

APPARATUS FOR ELECTROSTATIC POWDER SPRAY COATING AND RESULTING COATED PRODUCT

This is a divisional of co-pending application Ser. No. 871,972 filed on June 9, 1986.

BACKGROUND OF THE INVENTION

1. Field of the Invention

The present invention relates to electrostatic powder spray coating for producing evenly coated continuous films of thermoplastic and thermosetting powders on substrates or parts having electrically conductive geometrically complex surfaces and for enabling the use, without the occurrence of "cobwebbing," of significantly increased electrostatic charging voltages in electrostatic powder spray coating of preheated substrates and parts thereby to allow coating lines to be run faster.

2. Description of the Prior Art

With the increased attention given in recent years to cleaning up the environment, powder coating has increasingly come into use as a better solution than painting to protective, decorative and insulating problems. Powder coating has eliminated to a significant extent solid waste disposal and solvent emissions problems that are encountered with painting. This has resulted in much easier compliance with both stat and federally imposed environmental regulations as well as a reduction in energy costs because of a reduced need for venting. Additionally, almost all of powder overspray that occurs can be recovered and reused. The remaining one or two percent that cannot be recovered can easily be disposed of as a solid. Another significant advantage of powder coating is that it provides one coat coverage without runs and sags.

A number of methods have been employed in the prior art for applying powder coating materials. These include a fluidized powder bed process, an electrostatic fluidized bed process, and electrostatic powder spraying. Other known electrostatic powder application methods include an electrostatic powder disc drive and an electrostatic chamber.

In the fluidized bed process, a preheated part or substrate is dipped or immersed in a fluidized bed, the powder being fluidized by introducing compressed air through a porous membrane into the powder bed. Mechanical vibration of the powder bed may also be used to enhance fluidization. Upon coming into contact with a preheated part, the powder particles melt and adhere thereto. Post heating is required if the residual heat of the part is insufficient to cause the adhered powder particles to flow and cure.

The electrostatic fluidized bed process utilizes a fluidized powder bed and electrostatic charging electrodes to create a cloud of electrostatically charged powder particles in a chamber above the powder bed. The electrostatically charged powder particles, which are all charged alike, repel each other and move upward in the chamber. Grounded substrates or parts to be coated are dipped or immersed in the resulting cloud of charged powder particles. Preheating of the part is not necessary with this method of powder coating since the forces of electrostatic attraction cause the deposition of powder on the surface of the part irrespective of whether it is hot or cold. If the part is preheated, the powder particles will melt upon contact therewith and adhere. If the part is cold, the charges on the powder particles hold them in place until the part is post heated.

Electrostatic powder spray coating is a widely used method of applying powder coating materials to grounded substrates or parts. In this method of powder coating, powder coating particles are supplied to an actuatable spray gun and are electrostatically charged in the nozzle region thereof. Upon actuation of the spray gun, a cloud of comminuted charged powder particles is discharged from the gun. The gun is used to direct the cloud of charged powder particles toward the grounded substrate or art to be coated. The propelling force is provided by the electrostatic forces of attraction between the charged particles and the grounded part to be coated and by the air that is used to transport the powder from a supply thereof to the spray gun and to effect the discharge of such powder therefrom. Powder particles deposited on the part are held thereon by electrostatic forces. The coated part is then subjected to heat, in an oven, for example, where the layer of unfused powder particles melts, flows and cures to provide a continuous film.

A more detailed discussion of the foregoing methods of powder coating including those involving an electrostatic powder disc and an electrostatic chamber is given in the "Users Guide to POWDER COATING" published by the Association for Finishing Processes of the Society of Manufacturing Engineers, one SME Drive, Dearborn, Mich. 48121. Also, an in-depth discussion of the basic processes involved in electrostatic powder spray coating is given in the paper entitled "Surface films produced by electrostatic powder deposition" by A. W. Bright, Department of Electrical Engineering, University of Southampton S509 5NH, published in the J. Oil Col. Chem. Assoc. 60, 23–27.

The electrostatic powder spray guns most widely used commercially are basically of two types, specifically external charging and internal charging. In external charging powder spray guns, a charging electrode is located at the front or tip of the nozzle of the spray gun. This electrode, when energized with a high voltage, low amperage direct electrical current, produces an ion cloud or corona in the region of the electrode. Each of the powder particles is exposed to this ion cloud as it passes through it and thus has a charge placed thereon. The charge placed on the powder particles is usually negative with respect to ground potential although, if desired, it may also be positive. The charged powder particles form a charged powder particle cloud in front of the spray gun, which cloud is attracted to and moves toward the grounded substrate or part to be coated. This movement is assisted by air currents resulting from the operation of the spray gun and results in the powder being deposited on the part.

In internal electrostatic charging powder particles, the powder particles are passed through an ionizing field or corona that is produced between electrodes mounted internally of the spray gun. The charged powder particles discharged from the nozzle of the spray gun form a cloud in front of the gun, which cloud is attracted to the grounded substrate or part, assisted by air currents resulting from the spray gun operation.

Irrespective of the type of electrostatic powder spray gun employed, subsequent heating of the powder particle coated substrate or part melts and cures the powder particles to provide a continuous film.

Attempts in the prior art to speed up the electrostatic powder coating spraying operation by preheating the substrate or part to be coated and thereby eliminating the need for a separate subsequent heating and curing step have been beset with problems. One of these problems is the occurrence of a phenomena termed "cobwebbing", as illustrated in FIG. 1 of the drawings. As shown in FIG. 1, heated powder particles appear to coalesce and form cobweb-like strings that float and drift about the substrate or part to be coated and deposit thereon or subsequently drop to the floor of the spray booth. Such coalesced strings or cobwebs are not recoverable. The occurrence thereof seriously impairs the appearance of the surface of the coated part and the efficiency of the electrostatic powder spray system. Additionally, the presence of such coalesced powder strings in the oversprayed powder comprises a serious impediment to the operation of the recovery system that is employed to reclaim such oversprayed powder. Specifically, such coalesced strings tend to clog the filter employed in the recovery system as well as the supply lines to the nozzle, and the nozzle itself, of the electrostatic powder spray gun.

A solution proposed in the prior art for the cobwebbing problem is to reduce the voltage on the charging electrode of the electrostatic powder coating spray gun from a voltage level in the range of 60–80 kilovols (KV.), or perhaps higher, to a level of about 20 KV. While successful in reducing or suppressing cobwebbing in the electrostatic powder spraying of preheated substrates or parts, such reduction in voltage is undesirable because it significantly reduces the coating speed and requires slowing down of the powder coating lines.

Another solution employed in the prior art to solve the cobwebbing problem involves the addition of a siliceous ingredient specifically fumed silica, to the coating powder. While successful in reducing or suppressing cobwebbing in electrostatic powder spraying of preheated substrates or parts, the use of fumed silica, typically in he amount of 0.7 to 1.0%, is undesirable since it makes it harder to charge the powder particles and more difficult to deposit powder particles on the part to be coated. Additionally, the siliceous additive has been found hard to control in the manufacture of the powder and particularly in the overspray that is recovered and reused. In the absence of reasonably precise control, the appearance of the coating produced on the surface of the part being coated may be adversely affected with some areas appearing to be rough and dry.

Another problem that has been encountered in the prior art with electrostatic powder spraying of substrates or parts, particularly those with complex geometrical surfaces, is difficulty in effecting substantially even or uniform powder deposition in the inner portions of recesses and corners and associated side walls. This difficulty is widely believed to be due to a so-called "Faraday cage" effect. This effect is believed to involve repulsion of incoming charged powder particles by each other and by the charged layers of powder particles on opposing side walls. Such charged layers are believed to form before any charged powder particles can enter the inner portions of the recessed regions. It has been necessary, as a result, to expose the substrate or part for a longer time to the cloud of charged powder particles in the electrostatic powder spray to ensure that inner recessed areas and corner portions receive a powder coating layer. As a result, the thickness of the coating formed on outer portions of the associated side walls of recesses and corners has been found to be four or five times that of the coating on inner portions thereof.

By the terms "substantially uniform coating thickness" or "substantially even coverage," as used herein is meant a coating thickness on those portions of the substrate or part which are not subject to Faraday cage effects that is two times (or less) than that of the portions of the part that are subject to Faraday cage effects, and the thickness of the two portions can even be equal.

It is noted, as mentioned on page 79 of the aforementioned "User's Guide to POWDER COATING", that theories relating to internal charging of electrostatic powder spray guns claim the elimination of free ions in the charging process improves the deposition of powder in areas in which the "Faraday cage" effect inhibits coating. Irrespective of the validity of this claim, it is significant that no suggestion is made that internal charging provides a solution to the problem of an even powder coating on substrates and parts having geometrically complex surfaces.

Thus, there exists a need and a demand in the art for improvements in methods of and apparatus for electrostatic powder spraying for coating heated substrates or parts having complex geometrical surfaces to the end of avoiding cobwebbing while allowing the use of high electrostatic charging voltages and thereby allowing the coating lines to run faster, and achieving, also, uniform coating in inner portions of recessed regions or corners and the associated side walls. The present invention was devised to fill the technological gap that has existed in these respects.

SUMMARY OF THE INVENTION

An object of the invention is to provide a method of and apparatus for the electrostatic powder spray coating of grounded articles, substrates and parts (hereinafter "parts") having electrically conductive surfaces that are sufficiently complex so that portions thereof are subject to Faraday cage effects for producing a substantially uniform coating thickness on all surface areas including the inner portions of recesses and corners and the associated side walls of such parts.

Another object of the invention is to provide a method of and apparatus for the electrostatic powder spray coating of preheated parts which allows the use of high electrostatic charging voltages in the range of 60–80 KV. without the occurrence of cobwebbing.

A further object of the invention is to provide a method of and apparatus for the electrostatic powder spray coating of heated parts in which the recovery of overspray is facilitated.

Still another object of the invention is to provide a part which has a geometrically complex surface in which recesses and corners are formed and into the inner surface portions of which, in the prior art, the spray electrostatically of powder coating material has been inhibited, with an electrostatically sprayed powder coating of substantially even coverage which when heated forms a continuous film of substantially uniform thickness.

A further object of the invention is to provide a coated article having an electrically conductive surface that is sufficiently complex geometrically that at least portions thereof are subject to Faraday cage effects, which coated article has a powder coating material of substantially uniform thickness on the surface thereof that has been applied by a process including the steps of:

(a) producing and electrostatically charging a cloud of powder coating material particles (b) exposing the article to the cloud of powder coating material particles for the deposit thereon of said particles;

(c) subjecting the region adjacent the cloud of powder coating material, at a location remote from said article, to the influence of a grounded electrically conductive member; and (d) heating the coated article at a temperature sufficient to melt the powder coating material and provide a continuous coating film.

In accomplishing these and other objectives of the invention, an electrostatic powder spray gun, with external or corona charging, is provided with a grounded member which is positioned immediately adjacent the nozzle, at a position remote from the grounded and preheated substrate or part to be coated. The grounded member may be positioned in front of or to the rear of the nozzle of the electrostatic spray gun, but in a preferred embodiment, is positioned to closely encircle it. The grounded member is believed to significantly reduce if not substantially eliminate ionized atoms of air that are produced during the charging process of the powder particles as the latter are aspirated from the nozzle of the gun. That is to say, the ionization of the air adjacent the front of the nozzle of the gun and of the aspirating air that accompanies the spraying of the powder particles, is dissipated by the grounded member. As a result, the presence of ionized air atoms on the flow of the cloud of charged powder particles to the grounded part or substrate to be coated is suppressed. This is believed to cause a more uniform distribution of charged powder particles in the cloud, thus avoiding the tendency toward cobwebbing, and to reduce interference of charged powder particles between themselves and with ionized air atoms in entering the inner portions of recessed areas and corners.

It is to be understood, however, that the present invention is not to be limited to the foregoing theory or explanation. Also, such theory or explanation, however sound or valid, is not to be construed as necessarily constituting a full and complete explanation of what occurs during the electrostatic powder spray coating process. The present invention resides in a method of and apparatus for electrostatic powder spray coating that allows the use of faster coating lines without the occurrence of cobwebbing, which enables uniformity in the thickness of the powder coating of substrates with complex geometrical surfaces including the inner portions of recesses and corners, and in which the recovery and reuse of oversprayed powder is faciliated.

The materials which may be employed in the practice of this invention include, but are not limited to, powder coatings. The powder coatings fall into two general categories, thermoplastic and thermosetting.

The thermoplastic powder coatings useful in the practice of this invention are based on high molecular weight thermoplastic resins such as polyethylene, polypropylene, nylon, poly (vinyl) chloride and thermoplastic polyester resins. Other thermoplastic resins from which powder coatings are made include cellulose esters, ethylene-chlorotrifluoroethylene copolymer, poly (vinylidene fluoride) and poly (phenylene sulfide).

The thermosetting powder coatings which may be used in accordance with this invention are based on relatively low molecular weight resins which cross-link (either with themselves or with a cross-linking agent) upon exposure to heat. The generic types of resins used in such thermosetting powder coatings are epoxy, polyester and acrylic resins. Thermosetting powder coatings may also be made from the so-called "hydrid" resins which are blends of epoxy and polyester resins, and provide powder coatings with properties not obtainable when the individual resins are used alone.

Epoxy resin-based powder coatings may be either self cross-linking or may be cross-linked (cured) by a variety of curing agents. Examples of such curing agents include dicyandiamide, modified and substituted dicyandiamide and anhydrides. In addition to the curing agent, most epoxy-based powders contain a flow-control additive.

The polyester-based powder coatings employ hydroxy-functional polyesters which are cured through the hydroxyl sites. Curing agents useful with these polyesters include melamine-formaldehyde resin, isocyanates and the so-called "blocked" isocyanates. Typical of these curing agents is isophorone diisocyanate (IPDI) blocked with caprolactam.

The polyester powders may also be based on carboxy-functional polyesters. In this case the polyester may be cured with a polyepoxide such as triglycidyl isocyanurate (TGIC).

Typical acrylic resin-based powder coatings contain a resin made by copolymerizing glycidyl methacrylate into an acrylic resin backbone to provide a reactive group which can then be cured by, for example, a $C_{10}$–$C_{12}$ dibasic acid or a carboxy-terminated polymer.

All of the powder coatings described above may contain a variety of additives. Typical examples of additives include pigments, dyes, cure catalysts, flow control agents, fillers and the like.

Further description of the powder coatings useful in the practice of this invention may be found in Kirk-Othmer, Encyclopedia of Chemical Technology, Third Edition, Vol. 19, "Powder Coatings," pages 1–27, 1982 which is hereby incorporated by reference.

The various features of novelty which characterize the present invention are pointed out with particularity in the claims annexed to and forming a part of this specification. For a better understanding of the invention, its operating advantages, and specific objects attained by its use, reference is made to the accompanying drawings and descriptive matter in which preferred embodiments of the invention are illustrated.

BRIEF DESCRIPTION OF THE DRAWINGS

With this description of the invention, a detailed description follows with reference being made to the accompanying drawings which form part of the specification, in which like parts have been designated by the same reference numbers, and of which.

DESCRIPTION OF THE PRIOR ART

Figure 1:
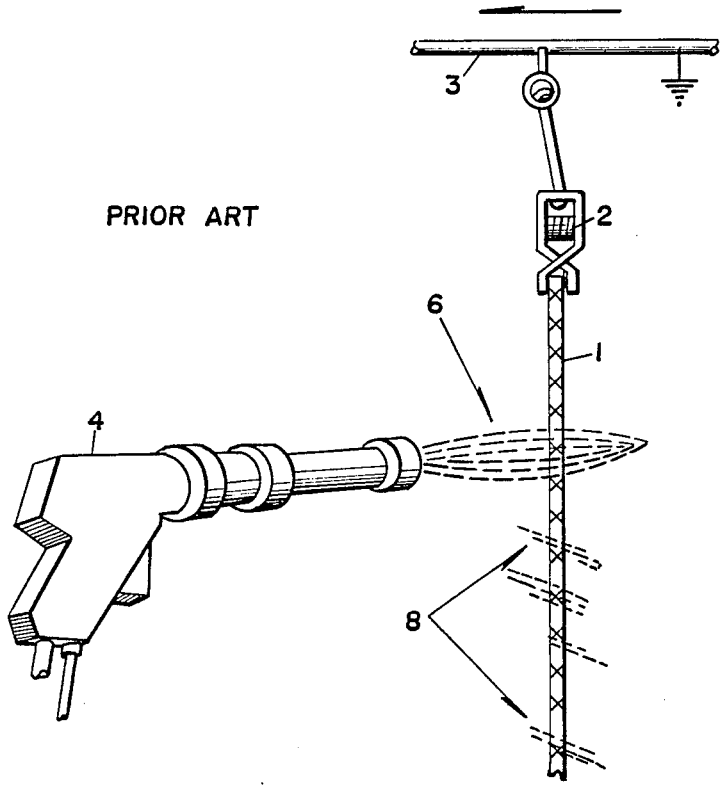
FIG. 1 is a fragmented view of an electrostatic spray gun operation illustrating the cobwebbing phenomena encountered in the prior art.

The cobwebbing problem encountered in the use of prior art electrostatic powder coating spray guns is illustrated in FIG. 1 of the drawings. In FIG. 1 the numeral 1 designates a steel bar that is to be electrostatically powder coated. Bar 1 is preheated to a temperature in the range of 450°-500° F. and is suspended at one end by a metallic clamp 2 from an overhead metallic support bar 3. Bar 3 is located in and is attached to a grounded spray booth (not shown) being grounded thereto. An electrostatic powder spray gun 4 which may be of commercially available type directs a cloud 6 of charged powder particles of thermosetting material toward the bar 1. Charged powder particles in cloud 6 that are deposited on bar 1 melt and cure to provide a continuous film on the peripheral surfaces of the bar 1. Others of the charged particles in cloud 6, however, coalesce and form cobweb-like strings, indicated at 8, that float and drift about bar 1, as shown, before falling to the floor of the spray booth.

DESCRIPTION OF THE PREFERRED EMBODIMENTS

Figure 2:
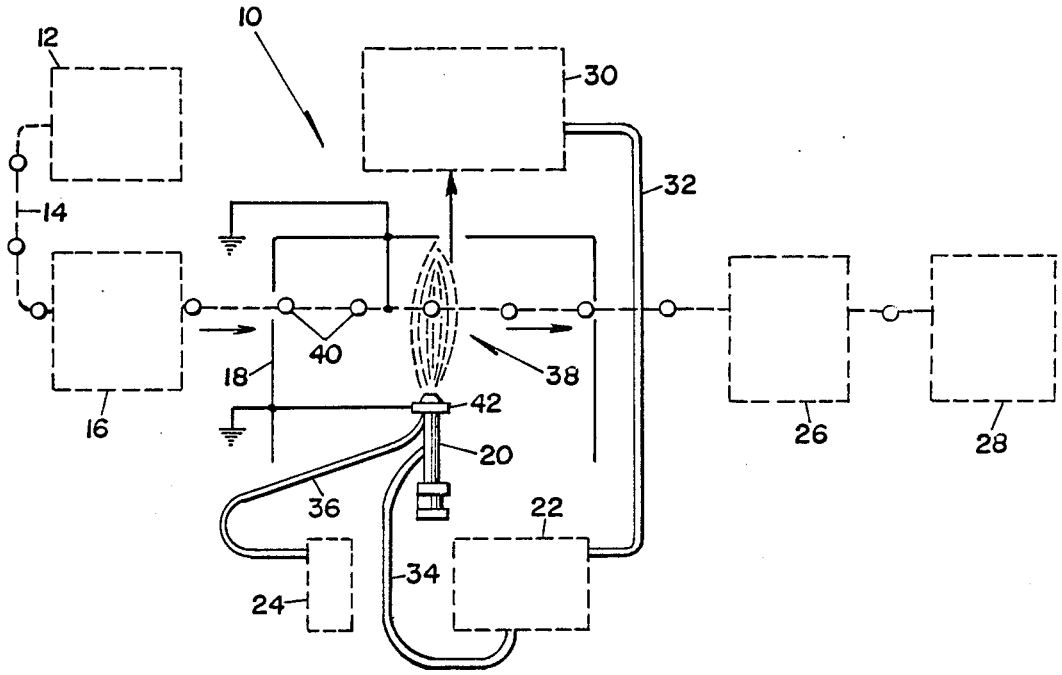
FIG. 2 is a schematic view illustrating an electrostatic powder spray gun coating system embodying the invention.

An electrostatic powder spray coating system according to the invention is illustrated in FIG. 2. This system which is indicated generally by the reference numeral 10, includes a loading area 12 for the parts to be coated, a travelling conveyor line 14, a heating oven 16, a spray booth 18, an external charging electrostatic powder spray gun 20 of commercially available type, a source of powder coating material 22, a source 24 of high direct current voltage with low amperage, a cooling region 26 for the coated parts, an unloading area 28 for the coated parts, a recovery unit and filter 30, and a conduit 32 for transporting reclaimed powder coating material from the recovery unit and filter 30 to the source of powder coating material 22. All of the parts are moved from the loading area 12 through the heating oven 16, spray booth 18 and cooling region 26 on the travelling conveyor line 14. A powder coating material 22 that advantageously may be employed is "Epoxiplate" R361, a fast curing thermosetting epoxy powder. "Epoxiplate" is a trademark of Armstrong Products Company, a division of Morton Thiokol, Inc., P. O. Box 647, Warsaw, Ind. 46580.

In the operation of the system 10, powder coating material is supplied to the electrostatic powder spray gun 20 from the source 22. Powder coating material from source 22 may be fluidized by air or vibration by means (not shown) and pumped by pumping means (not shown) to the electrostatic powder spray gun 20. The pumping means operates as an aspirator in which a forced airflow draws powder coating material from the source into a conduit or feed tube 34 leading to the gun 20. Such airflow separates the particles of the powder coating material 22. This facilitates transporting the powder coating material 22 to the gun 20 and also enhances the electrostatic charging capability of the particles thereof.

The particles of coating material 22 are charged by a charging electrode, which charging electrode may comprise a needle and is adapted to be energized from the high voltage direct current source 24, being connected thereto by a suitable cable 36. The charging electrode is located in a central region of the nozzle of the gun 20 through which the sprayed particles of coating material are aspirated. To the end of providing an intensely ionized electrostatic field at the charging electrode, and hence, effective charging of the powder particles and consequently, maximum rate of film growth for a given exposure time, on the part being coated, the voltage of the high voltage source 24 preferably is set at a high level in the range of 60-80 KV. While the charge placed on the powder particles may be either positive or negative with respect to ground potential, they will be considered for the purposes of this description to be negatively charged.

As previously noted, such charging of the powder particles, known as corona charging, is effective also to charge atoms of air adjacent the front of the nozzle of gun 20 and in the airflow that transports the powder particles from source 22 to the gun 20 and carries them therefrom.

The cloud of charged powder particles, as indicated by reference numeral 38, moves under the influence of air currents resulting from the spraying operation of gun 20 and under the influence of the electrostatic forces of attraction between the negatively charged powder particles and preheated grounded parts, designated 40, to be coated. While the representation of parts 40 in FIG. 2 is abstract and shows no surface detail, it will be understood that the parts 40 may include recesses and corners, for example, as would be present in a bar with deformations on the surface thereof in the form of an X-pattern. Such a bar is shown in FIG. 1.

The grounding of parts 40 may be effected by their connection to the travelling conveyor line 14 or in any other suitable manner. Powder particles that are deposited on the parts 40 melt, and if thermosetting, cure to provide a continuous film on the surface of the parts.

There is provided, in accordance with a preferred embodiment of the invention, a grounded electrically conductive ring 42, which may be similar to a hose clamp, that is provided in encircling relation with the nozzle of gun 20 adjacent the tip thereof. It has been found that the use of ring 42 in this manner, electrically connected to ground, effectively solved the problem of cobwebbing, eliminating any such tendency even when high charging voltages in the range of 60-80 KV. or higher are employed. It has been found, also, that the ring 42, when used, solves the problem of the "Faraday cage" effect in that coatings or films of uniform thickness are provided on the inner surfaces of recesses and corners and the associated side walls and other surface areas of the parts 40, the thickness of the film being determined by the time of exposure of the part 40 to the cloud 38 of charged particles.

While in the system of FIG. 2 only one electrostatic powder spray gun 20 is employed, it will be understood that several such guns may be used simultaneously if desired in coating the succession of parts 40 being moved through the spray booth 18.

Further understanding may be gained from the following examples.

EXAMPLE I

Employing an electrostatic powder spray gun 20 including the grounded ring 42 as described in connection with FIG. 2, a #5 steel bar with dimensions comprising 16 mm. diameter and 50.1 mm. perimeter and having X-pattern deformations on the surface thereof, as shown in FIG. 1, was heated to a temperature in the range of 450°-500° F. The bar was grounded and rotating about its longitudinal axis one revolution per second. The electrostatic powder spray gun, set at a charging voltage level of 80 KV., was positioned eight inches from the bar. The coating material was "Epoxiplate" R361, a fast curing epoxy powder which has been mentioned previously herein. The procedure resulted in the application, with no cobwebbing, of a continuous coating or film of uniform thickness on the peripheral surface of the bar including the inner surface portions of recesses, and corners of the X-pattern on the bar.

EXAMPLE II

A two-bar coating line has two parallel bars, each of which is identical to that described in Example I but is non-rotating, spaced six to eight inches apart entering a spraybooth with two electrostatic powder spray guns positioned above the bars and two electrostatic powder spray guns positioned below the bars, with the guns all being of the type described in connection with FIG. 2 and with each including a grounded ring 42. Using "Epoxiplate" R361 fast curing epoxy powder with the spray guns set at a charging voltage level in the range of 60–80 KV. and the parallel bars moving through the spray booth at a line speed of 30–40 feet per second, the procedure resulted in the application, with no cobwebbing, of a continuous coating or film of uniform thickness on all of the peripheral surfaces of each of the bars, including the inner surface portions of recesses and corners of the X-patterns on the bars.

Figure 3:
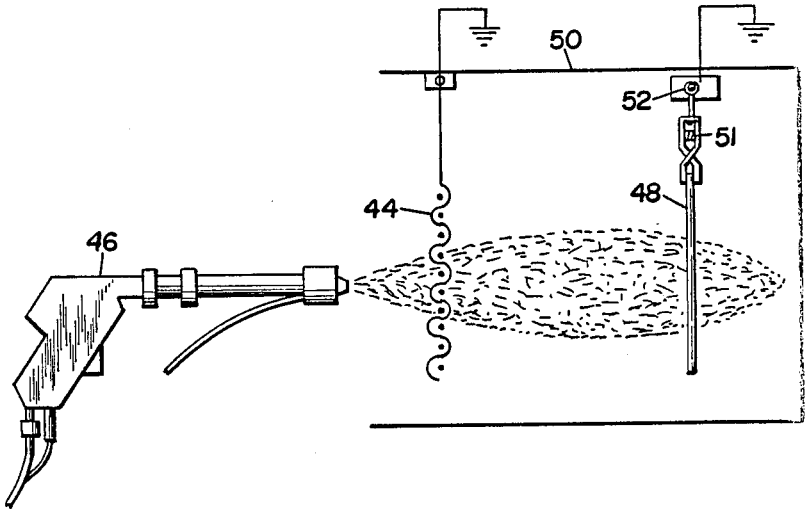
FIG. 3 illustrates another embodiment of the invention including a mesh screen member for grounding of the electrostatic field near the powder spray discharge point on an external charging powder spray gun.

In FIG. 3 there is shown another embodiment of the invention in which a grounded metallic mesh screen 44 having openings of approximately one-half inch is positioned between a hand-held electrostatic powder spray gun 46 and a preheated bar 48 to be coated. Spray gun 46 may be a commercially available type such as the Personal Solidspray self-contained powder application gun marketed by Volstatic, Inc., 7960 Kentucky Drive, Florence, Ky. 41042. It is noted that all of the operations described herein in connection with FIG. 3 and with FIGS. 4 through 11, also, were performed using this Volstatic gun. Since the detailed construction per se of the electrostatic powder spray gun forms no part of the present invention, it will not further be described in any detail herein.

Bar 48, as seen in FIG. 3, may be similar to the bar 1 of FIG. 1 and is positioned in a spray booth 50, being suspended at one end by a metallic clamp 51 from a grounded support bar 52. Thus, bar 48 is grounded to the spray booth 50. The electrostatic spray gun 46 may be similar to that employed in FIG. 2 except that the grounded ring 42 has been omitted.

Operation of this arrangement with the bar preheated to a temperature of about 500° F., the gun 46 spaced about four inches from the grounded mesh screen 44 and about eight inches from the bar 48, and using Epoxiplate R361 coating material, with or without the fumed silica additive mentioned hereinbefore, resulted in no cobwebbing. The coating material reaching the vicinity of the bar 48 appeared to have lost some or all of its electrostatic charge, however, since the attraction thereof to the grounded bar 48 seemed diminished. Upon removal of the grounded screen 44, the coating material cobwebbed:

FIGS. 4–11 illustrate a number of grounded circle or ring structural configurations that may be substituted for the grounded mesh screen 44 in the electrostatic powder coating arrangement of FIG. 3 for eliminating cobwebbing. Of these structural configurations, that illustrated in FIG. 11 and described hereinafter is preferred.

Figure 4:
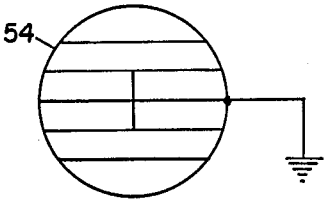
FIGS. 4 and 5 illustrate other embodiments of the invention comprising grounded circles of wire, that is, a wire ring, with cross bars for effecting the grounding of the electrostatic field near the powder spray discharge point on an external charging powder spray gun.

The circle or ring of wire 54 shown in FIG. 4 is provided with vertical and horizontal bars running through the ring. The diameter of the ring 54 is about seven inches. Holding the elec.trostatic spray gun 46 approximately six inches from the circle, with the powder spray concentrated at the center of the circle, no cobwebbing resulted. As the electrostatic powder spray gun 46 was moved closer to the center of the ring 54, the charge on the coating material or powder in the vicinity of the bar 48 appeared to increase with consequent greater attraction to the grounded bar 48.

Figure 5:
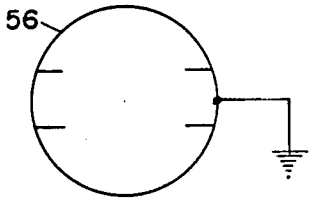

The ring 56 of FIG. 5 differs from the ring 54 of FIG. 4 in that the vertical and horizontal cross bars have been omitted, four short horizontal wire sections o pins being provided instead.

With a grounded seven inch ring, as shown in FIG. 5 substituted for the grounded mesh screen 44 in the arrangement of FIG. 3, the coating material was attracted to the bar 48 significantly better than with either screen 44 or ring 54, again with no cobwebbing. Powder coating material was sprayed at the center of the ring 56, being positioned approximately one to two inches therefrom. While there was no cobwebbing, the bar 48 in certain surface areas took on a rough, dry finish.

Figure 6:
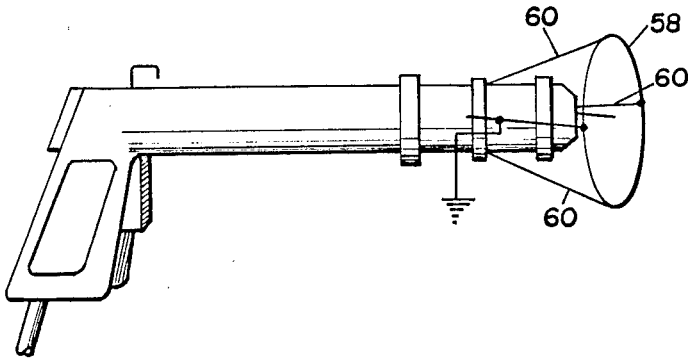
FIG. 6 illustrates another embodiment of the invention comprising the mounting of a grounded wire ring on the nozzle of the electrostatic powder spray gun, shown in perspective, with the ring flush with the charging electrode tip of the gun.

FIG. 6 illustrates a further embodiment of the invention in which a six inch diameter ring 58 having no cross bars or horizontal sections is positioned flush with the electrode tip of the electrostatic gun 46 by several thin rearwardly directed metallic rods 60. Rods 60 may be taped or clamped to the barrel of the gun 46 and grounded to the spray booth 50. This position of the ring 58 is indicated as position "A" in FIG. 7. With this arrangement, powder coating material was sprayed on a bar 48 preheated to a temperature of 530° F., approximately three to four inches from the bar 48. The results were that the powder charged well, there was good powder particle delivery, and there was no cobwebbing. The appearance of the bar, however, was semi-rough in areas. It is noted that the electrode charging voltage on the electrostatic powder spray gun 46 without a ground connection to the ring 58 was in the range of 30–40 KV. depending on the distance from the gun electrode to the bar 48. With the ground wire attached to the ring 58, the electrode charging voltage of gun 46 was a constant 30 KV.

Figure 7:
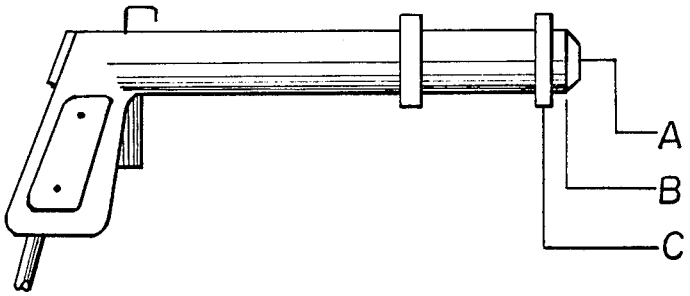
FIG. 7 illustrates different invention embodiments with a grounded ring in different positions relatively to the nozzle of the electrostatic powder spray gun.

Operation with a ring 58 having a diameter of nine inches and supported at the tip of the nozzle of the electrostatic spray gun 46, indicated as position "A" in FIG. 7, also produced coating of the grounded bar 42 with no cobwebbing. The coating powder, however, did not appear to charge well, the powder cloud pattern appearing radical and the appearance of the coating on the bar 42 being rough.

Operation with the nine inch ring 58 at the position "B", as seen in FIG. 7, gave somewhat better results, there being no cobwebbing with fair powder charging. The powder cloud pattern was widespread, however, and the appearance of the coating on the bar 42 was rough.

With the six inch ring 58 at the position "B" as seen in FIG. 7, operation produced no cobwebbing, the powder charged better, and the powder cloud pattern was fair.

Somewhat better results were obtained with the six inch ring in the position "C", as seen in FIG. 7. In that position, operation produced no cobwbing, the powder charged well and the powder cloud pattern was good.

The farther the six inch ring 58 is positioned behind the electrode of the electrostatic powder spray gun 46, the better the coating of "Epoxiplate" R361 applied. The appearance of the coating on the preheated and grounded bar 48 improves also the farther, back the six inch ring 58 is positioned. Additionally, the performance of the powder coating operation improved with the smaller, that is, the six inch ring 58.

The foregoing operations were repeated using a grounded three inch grounded wire ring 58, as shown in FIG. 6, substituted for the grounded wire mesh screen 44 in the arrangement of FIG. 3, with the three inch ring 58 successively positioned in each of the three positions "A", "B" and "C" shown in FIG. 7. Operation in each of the "A" and "B" positions with the electrostatic powder spray gun 46 held two to four inches from the bar 48 resulted in no cobwebbing with the powder charging good and the powder pattern being fair. Operation in the "C" position also produced no cobwebbing. Here the powder charged well and the powder pattern was good, but the appearance of one-fourth of the bar 48 was rough with the remaining three-fourths being good.

Figure 8:
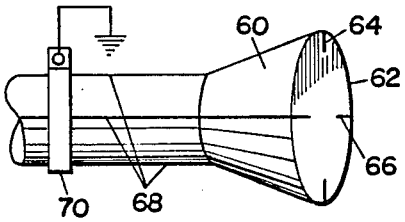
FIG. 8 shows still another embodiment of the invention with the grounded ring supported by a plastic cone that is positioned on the nozzle of the electrostatic powder spray gun and is provided for shielding against electrostatic field interference.

The embodiment of the invention illustrated in FIG. 8 includes an electrostatic shield comprising a plastic cone 60 having a diameter of four inches at its larger and forward end for reducing electrostatic field interference. A wire ring 62 wich is supported on the forward end of cone 60, includes two pairs of diametrically opposed inwardly projecting pins, indicated at 64 and 66, which are ecch approximately one-fourth of an inch long. Pins 64 and 66 are positioned to be exposed to the electrostatic field produced by the external charging electrode of the electrostatic powder spray gun 46. Wires 68 which extend along the outside of cone 60 from ring 62, being electrically connected thereto, are attached by a hose clamp 70 to the barrel of the spray gun 46. Clamp 70 is grounded to the spray booth 50. Employing the wire ring 62 as another alternative for the mesh screen 44 of the FIG. 3 arrangement, the operations previously mentioned with reference to FIG. 7 were repeated, spraying bar 48 from top to bottom, with the following results. Operation in the "A" position produced no cobwebbing, the powder charged well, and the cloud pattern was good. The appearance of the coating on the bar 48, however, was rough. Operation in the "B" position was substantially the same as that in the "A" position except that the appearance of the coating on the bar 48 was improved. In the "C" position, there was no cobwebbing, the powder charge was good, the powder cloud pattern was good, and the appearance of the coating on the bar was very good although there was still some slight roughness.

Figure 9:
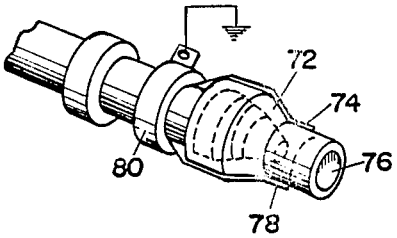
FIGS. 9 and 10 show further embodiments of the invention comprising modifications of the plastic shield of FIG. 8.

A modification of the plastic cone 60 for providing a shield against electrostatic field interference is illustrated in FIG. 9. As shown, the shield 68 of FIG. 9 comprises a polyvinyl chloride plastic pipe 72 the larger end of which is arranged in close encircling relation with the nozzle of the electrostatic spray gun 46 and the smaller end of which projects forwardly of the tip of the charging electrode of gun 46. The tips, forming probes, of three wires 74, 76 and 78 project through the wall of the forward end of pipe 72 sufficiently to expose about one-eighth thereof to the electrostatic field, the arrangement being such that the exposed wire tips are spaced equally apart in the same plane, as shown, forwardly of the charging electrode of the gun 46. The other ends of wires 74, 76 and 78 extend rearwardly over the external surface of the pipe 2 and are clamped to the barrel of the spray gun 46 by a hose clamp 80 which is grounded to the spray booth 50. Holding the spray gun 46 approximately three to five inches from the bar 48, with the latter preheated to a temperature of approximately 520° F. and a charging voltage of 30 KV. applied to the gun, there was no cobwebbing, the powder charged well, the powder cloud pattern was good, and the coating appearance on the bar was good.

Figure 10:
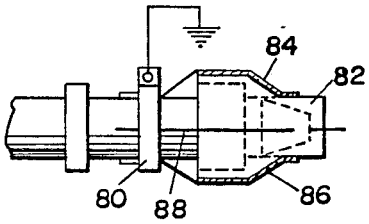

The embodiment of the invention illustrated in FIG. 10 employs a polyvinyl chloride plastic pipe 82 that is similar to the pipe 72 of FIG. 9 and also employs three wires 84, 86 and 88 that are similar to the wires 74, 76 and 78 of FIG. 9. In FIG. 10, however, the forward tips or probes of each of the wires 84, 86 and 88 project through the wall of the pipe 82 at a position behind the charging electrode of the spray gun 46. With the spray gun 46 approximately three to five inches from the bar 48, with the latter heated to a temperature of approximately 520° F., air pressure of 25 pounds applied to the gun 46, and a charging voltage of 85 KV., there was no cobwebbing, the powder charged great, the powder cloud pattern was great and the coating appearance of the bar 48 was good. It is noted that similar results were obtained with Epoxiplate R361 coating powder with or without the fumed silica additive except that with the additive the appearance of the coating on the bar 48 appeared to be somewhat better.

Figure 11:
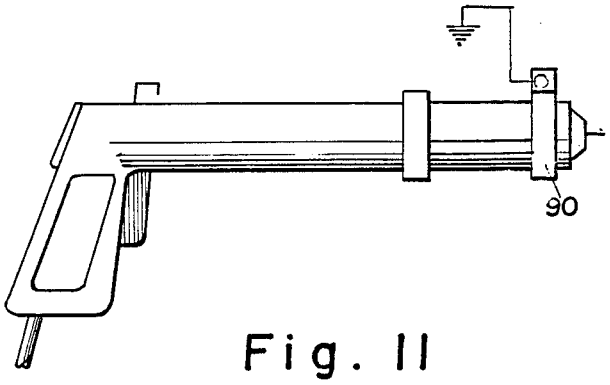
FIG. 11 illustrates a preferred embodiment of the invention.

In FIG. 11 an electrically conductive and grounded ring 90 which resembles, that is, has the configuration of a hose clamp, is positioned in encircling relation to the front end or nozzle of the electrostatic powder spray gun 46 immediately behind the charging electrode thereof. With the preheated bar 48 to be coated at a temperature of 530° F., a charging voltage to the spray gun 46 of approximately 85 KV., and the spray gun held at a distance of approximately one foot from the bar 48, operation of the spray gun 46 resulted in no cobwebbing, good charge of the coating powder, and good pattern of the powder cloud, with the coating appearance on the bar good.

It will be understood that, while for convenience of explanation, the bar to which a powder coating is applied in each of the embodiments of FIGS. 3–11 has been designated by the same reference numeral 48, the bar 48 in each of the embodiments was a different and previously uncoated bar.

While the invention, in the embodiments of FIGS. 2 through 11, is directed to the application thereof to externally charged electrostatic powder spray guns, it will be understood that it is applicable also to internally charged electrostatic powder spray guns for eliminating cobwebbing and enabling uniformity in the thickness of the parts being coated including the inner portions of recesses and corners.

Figure 12:
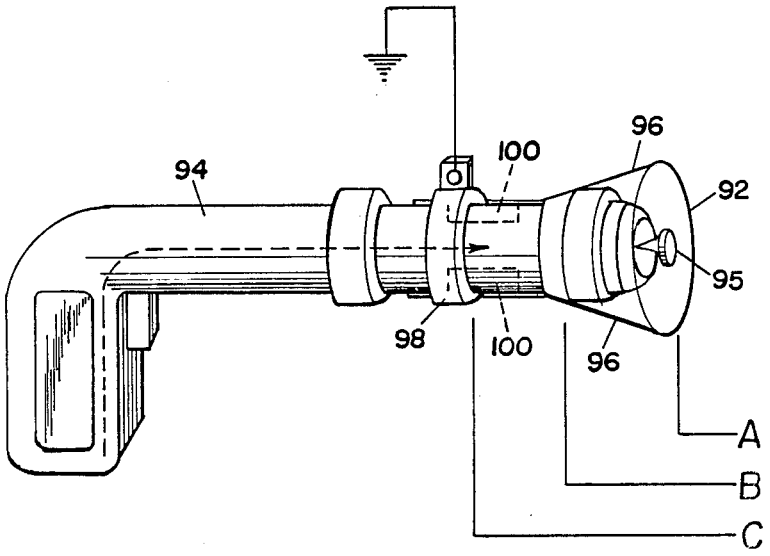
FIG. 12 illustrates another embodiment of the invention in which a grounded ring is applied to an internally charged electrostatic powder spray gun.

Thus, in FIG. 12, there is illustrated an application of a grounded ring 92 according to the invention to a commercially available internally charged hand-held electrostatic powder spray gun 94 provided with a deflector 95 at the front end. The spray gun 94 may be a commercially available type, for example, that marketed by Ransburg Gema, 3939 West 56th Street, Indianapolis, Ind. 46208.

The grounded ring 92, as shown, may have a configuration similar to that illustrated in FIG. 6 and is supported at the front end of the spray gun 94 by several thin rearwardly directed metallic rods 96 that may be fastened to the barrel of gun 94 by a clamp 98 that is grounded to the spray booth. The internally charging electrodes of spray gun 94 are shown in dotted lines and are indicated by reference number 100. Operation with the grounded ring 92 having a diameter of three inches and placed at position "A" indicated in FIG. 12 produced no cobwebbing. The powder did not charge well, the powder cloud pattern was widespread, and the coating appearance on the bar (not shown) being coated was fair. Operation with the three inch grounded ring 92 at position "B" in FIG. 12 produced no cobwebbing with the powder charge improved, the powder cloud pattern better, and a better coating appearance on the bar. Operation with the same grounded ring 92 at position "C" in FIG. 12 produced no cobwebbing while the powder charged well, the powder cloud pattern was fair and the coating appearance on the bar was good. Operation with the same grounded ring 92 at position "C", with the deflector 95 at the front end of spraygun 94 removed, resulted in the bar being coated very well with no cobwebbing.

Figure 13:
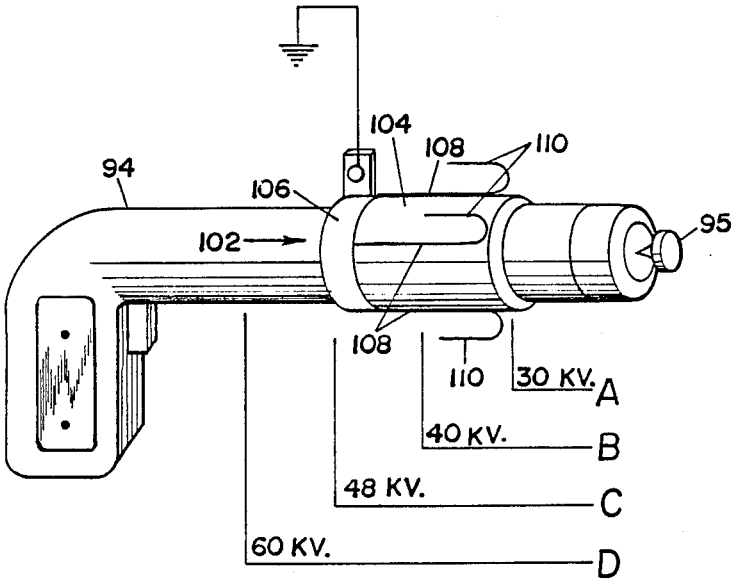
FIG. 13 illustrates still another embodiment of the invention comprising another configuration for the grounded ring applied to an internally charted electrostatic powder spray gun.

In FIG. 13 there is illustrated another configuration for the grounded ring applied to an internally charged electrostatic powder spray gun that may be identical to the spray gun 94. The grounded ring, designated generally by numeral 102 in FIG. 13, is supported by a plastic sleeve 104 that fits over the front end of spray gun 94, in snug engagement therewith. Supported on plastic sleeve 104, at the rear end thereof, is a grounded metallic ring 106. Projecting forwardly from ring 106 are three copper wires 108 that extend slightly beyond the front end of plastic sleeve 104 where they each include a curved radially and rearwardly extending section 110. Operation with this grounded metallic ring in the position "A", indicated in FIG. 13, produced no cobwebbing with good powder charging, good powder cloud appearance, and good coating on the bar. Operation in the position "B" produced no cobwebbing with better powder charging, better cloud pattern and better appearance of the coating on the bar. Operation in the position "C" produced good powder charging, good powder cloud pattern and good appearance of the coating on the bar, with slight strings of cobwebbing, however, on the deflector 95. Operation in the position D produced cobwebbing.

Thus, in the operation of the internally charged spray gun 94, it appears that there is a short section of the barrel of the gun 94, specifically about a three inch region adjacent the front end of the gun 94, where the sleeve 104 and the grounded ring 102 works fine. Operation of the gun 94 with the ring 102 in front of or behind that region results in cobwebbing.

Operation of the internally charged powder spray gun 94 with the grounded mesh screen arrangement of FIG. 3 and the grounded ring configurations shown in FIGS. 4, 5 and 8 produced the following results. With the grounded mesh screen 44 of FIG. 3 and the grounded ring of FIG. 4, there was no cobwebbing, but there appeared to be no charge on the powder and the cloud pattern was bad. There was no cobwebbing with the grounded ring of FIG. 5 with there being a slight charge on the powder and a bad cloud pattern. With the grounded ring of FIG. 8, there was no cobwebbing. There was a slight improvement in the charge with a fair powder cloud pattern.

The closer the plastic sleeves and grounded rings are positioned to the front of the gun with the internally charged powder spray gun 94, the lower the charging voltage, indicated in kilovolts in FIG. 13. The farther back the sleeves and grounded rings are from the front of the tip of the gun 94, the higher the charging voltage. Also, with the sleeves and grounded rings positioned too far back, cobwebbing occurs.

It is noted that in at least those embodiments of the invention described, including the internally charged as well as the externally charged electrostatic powder spray guns, where no cobwebbing was encountered and the appearance of the coating produced on the heated bar was indicated as good, the bar was coated evenly with a continuous film on all peripheral surfaces that were exposed to the cloud of powder particles including the inner portions of recesses and corners.

Thus, in accordance with the invention there has been provided an improved method of and apparatus for the electrostatic powder spray coating of parts having geometrically complex surfaces. The improved method of and apparatus is characterized in being effective to produce a coating of continuous film of uniform thickness on the peripheral surfaces of the parts being coated including the inner portions of recesses and corners. The improved method of and apparatus provided according to the present invention is further characterized in that it enables the use of higher electrostatic charging voltages, and hence, faster coating line operation, without the occurrence of cobwebbing in the coating of preheated parts. As a consequence, there is enabled the production of parts coated evenly with a continuous film at a faster rate with the recovery for reuse of overspray being facilitated.

With this description of the invention in detail, those skilled in the art will appreciate that modifications may be made to the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. Apparatus for the electrostatic powder spray coating of a grounded preheated part having an electrically conductive surface comprising, a source of comminuted powder coating material, an actuatable electrostatic powder spray gun having a charging electrode of the corona charging type, said gun having a nozzle at the front end thereof and adapted when actuated to effect the discharge of comminuted powder coating material from said nozzle in the form of a cloud for deposition on the surface of said part, means associated with said source of powder coating material and with said gun for delivering said powder coating material to said gun for discharge from the nozzle thereof, means for energizing the charging electrode of said gun to apply an electrostatic charge to said comminuted powder charge material as said material passes through said gun, and a grounded electrically conductive member positioned in operative relation with the front end of said gun at a location remote from said part to be coated, wherein said grounded electrically conductive member is put between said gun and said part to be coated to cause a more uniform distribution of charged powder particles in the cloud of charges particles thus avoiding a tendency toward cobwebbing, whereby to effect substantial evenness in the coverage of the comminuted material deposited on the surface of said preheated part and thereby the melting of said comminuted powder coating material to effect the coating of the surface of said part with substantially even coverage with a continuous film.

2. Apparatus for the electrostatic powder spray coating of a grounded preheated part having an electrically conductive surface comprising, a source of comminuted powder coating material, an actuatable electrostatic powder spray gun having a charging electrode of the corona charging type, said gun having a nozzle at the front end thereof and adapted when actuated to effect the discharge of comminuted powder coating material from the nozzle in the form of a cloud for deposition on the surface of said part, means associated with said source of powder coating material and with said gun for delivering said powder coating material to said gun for discharge from the nozzle thereof, means for energizing the charging electrode of said gun to apply an electrostatic charge to said comminuted powder charge material as said material passes through said gun, and a grounded electrically conductive member positioned in operative relation with the front end of said gun at a location remote from said part to be coated, wherein said grounded electrically conductive member comprises a grounded ring that encircles and is positioned substantially transversely with respect to the front end of said gun, whereby to effect substantial evenness in the coverage of the comminuted material deposited on the surface of said preheated part and thereby the melting of said comminuted powder coating material to effect the coating of the surface of said part with substantially even coverage with a continuous film.

3. Apparatus as defined by claim 2 wherein said grounded ring closely encircles the front end of said gun and resembles a hose clamp.

4. Apparatus as defined by claim 3 wherein said electrostatic powder spray gun is of the external charging type.

5. Apparatus as defined by claim 2 further including a plastic conical shield positioned over the front end of said gun with the larger opening thereof facing forwardly of the front end of said gun, and wherein said grounded ring is positioned on the front edge of said shield.

6. Apparatus as defined by claim 2 wherein said grounded ring is positioned in close encircling relation with the front end of said gun and has attached thereto a plurality of wires that project forwardly of said gun with each of said wires having a radially inwardly extending tip at the front end thereof, and further including a plastic tube positioned over the front end of said tube with the front end of said tube extending beyond the charging electrode of said gun, said wires being supported on said plastic tube, exteriorly thereof, with the tips thereof extending through the wall of the plastic tube into a region therein adjacent the charging electrode of said gun.

7. Apparatus as defined by claim 6 wherein the tips of said wires extend through the wall of said plastic tube at a region therein in front of the charging electrode of said gun.

8. Apparatus as defined by claim 6 wherein the tips of said wires extend through the wall of said plastic tube at a region therein behind the charging electrode of said gun.

9. Apparatus for the electrostatic powder spray coating of a grounded preheated part having an electrically conductive surface comprising, a source of comminuted powder coating material, an actuatable electrostatic powder spray gun having a charging electrode of the corona charging type, said gun having a nozzle at the front end thereof and adapted when actuated to effect the discharge of comminuted powder coating material from said nozzle in the form of a cloud for the deplosition on the surface of said part, means associated with said source of powder coating material and with said gun for delivering said powder coating material to said gun for discharge from the nozzle thereof, means for energizing the charging electrode of said gun to apply an electrostatic charge to said comminuted powder charge material as said material passes through said gun, and a grounded electrically conductive member positioned in operative relation with the front end of said gun at a location remote from said part to be coated, wherein said grounded electrically conductive member comprises a grounded ring that encircles and is located at an intermediate position with respect to said gun behind the nozzle thereof, said grounded ring being positioned transversely of said gun, and wherein said gun is of the internal charging type, whereby to effect substantial evenness in the coverage of the comminuted material deposited on the surface of said preheated part and thereby the melting of said comminuted powder coating material to effect the coating of the surface of said part with substantially even coverage with a continuous film.

* * * * *